US007257854B2

(12) United States Patent
Petner

(10) Patent No.: US 7,257,854 B2
(45) Date of Patent: Aug. 21, 2007

(54) REVERSIBLE CLEANING BONNET

(75) Inventor: Robert E. Petner, Burlington, NJ (US)

(73) Assignee: Quickie Manufacturing Corp., Cinnaminson, NJ (US)

( * ) Notice: Subject to any disclaimer, the term of this patent is extended or adjusted under 35 U.S.C. 154(b) by 298 days.

(21) Appl. No.: 11/069,150

(22) Filed: Mar. 1, 2005

(65) Prior Publication Data

US 2006/0196000 A1 Sep. 7, 2006

(51) Int. Cl.
*A47L 13/10* (2006.01)
*A47L 13/12* (2006.01)

(52) U.S. Cl. ..... 15/247; 15/118; 15/228

(58) Field of Classification Search ..... 15/229.4, 15/229.8, 228, 247, 118
See application file for complete search history.

(56) References Cited

U.S. PATENT DOCUMENTS 2,301,586 A * 11/1942 Rubin ..... 15/147.2
2,831,207 A * 4/1958 Thompson et al. ..... 15/228
3,395,416 A * 8/1968 Hughes ..... 15/228
3,528,076 A * 9/1970 Anderson ..... 15/228
3,528,120 A * 9/1970 Lindstrom ..... 15/228
4,114,223 A * 9/1978 Buchanan ..... 15/228

* cited by examiner

*Primary Examiner*—Randall Chin
(74) *Attorney, Agent, or Firm*—Stuart M. Goldstein

(57) ABSTRACT

A reversible cleaning bonnet has a unitary central body member with first and second face surfaces. The body is encompassed by a cover which has two cleaning surfaces, i.e. either two scrubbing, polishing, dusting, mopping, etc. surfaces, or any combination of these surfaces The cover also has an elastic band which permits the bonnet to be attached to the cleaning head of a cleaning implement. The elastic band also permits the cover to be changed from one position in which one of the cleaning surfaces is exposed for use, to a second position which permits the second cleaning surface of the cover to be exposed and used.

5 Claims, 3 Drawing Sheets

REVERSIBLE CLEANING BONNET

BACKGROUND OF THE INVENTION

There are a multitude of cleaning implements which are designed to dust, wipe, scrub, polish, clean, etc. a wide variety of surfaces. Narrowing the field in this context, many of these implements have a handle and a cleaning head which employs removeable cleaning head elements which take many forms, e.g. scrub pads, wipe and dust cloths, strand mops, cellulous and/or synthetic cleaning sheets or strips, bonnets for dusting, polishing, cleaning, scrubbing, etc. Many of these removeable cleaning elements are washable and reusable and some are simply removed and discarded.

What all these cleaning head elements have in common is that they all have only a single cleaning surface and, as a result, can only be used for one purpose. So, for example, if a surface is scrubbed with a scrub pad or similar cleaning surface and a gentle wipe down or drying of a surface is then required, a different cleaning surface and, routinely, a different cleaning implement must be used or a different cleaning head element must be retrieved and replaced on the cleaning implement. There is no cleaning head element which has the versatility to be used for more than one cleaning function or an element which, when its cleaning surface is worn, can be repositioned with a second cleaning surface.

SUMMARY OF THE INVENTION

It is thus the object of the present invention to provide a cleaning bonnet which overcomes the limitations and disadvantages of prior cleaning elements.

It is an object of the present invention to provide a cleaning bonnet which has two different and distinct cleaning surfaces.

It is a further object of the present invention to provide a cleaning bonnet which is configured to readily attach to the head of a cleaning implement.

It is still a further object of the present invention to provide a cleaning bonnet which can easily and readily be removed from the head of a cleaning implement, washed, and reused.

It is another object of the present invention to provide a cleaning bonnet which has the versatility for use in more than one cleaning type application.

It is still another object of the present invention to provide a cleaning bonnet which has two cleaning surfaces, so that when one surface is soiled, the second surface can be used.

It is another object of the present invention to provide a cleaning bonnet which is easily manufactured and simple to use.

These and other objects are accomplished by the present invention, a reversible cleaning bonnet which has a unitary central body member with first and second face surfaces. A cover encompasses the body member. The cover has two distinct cleaning surfaces, i.e. either two scrubbing, polishing, dusting mopping, etc. surfaces, or any combination of these surfaces. The cover also has an elastic band which permits the bonnet to be attached to the cleaning head of a cleaning implement. The elastic band also permits the cover to be changed from one position in which one of the cleaning surfaces is exposed for use, to a second position which permits the second cleaning surface of the cover to be exposed and used.

The novel features which are considered as characteristic of the invention are set forth in particular in the appended claims. The invention itself, however, both as to its design, construction, and use, together with additional features and advantages thereof, are best understood upon review of the following detailed description with reference to the accompanying drawings.

DETAILED DESCRIPTION OF THE INVENTION

Figure 4:
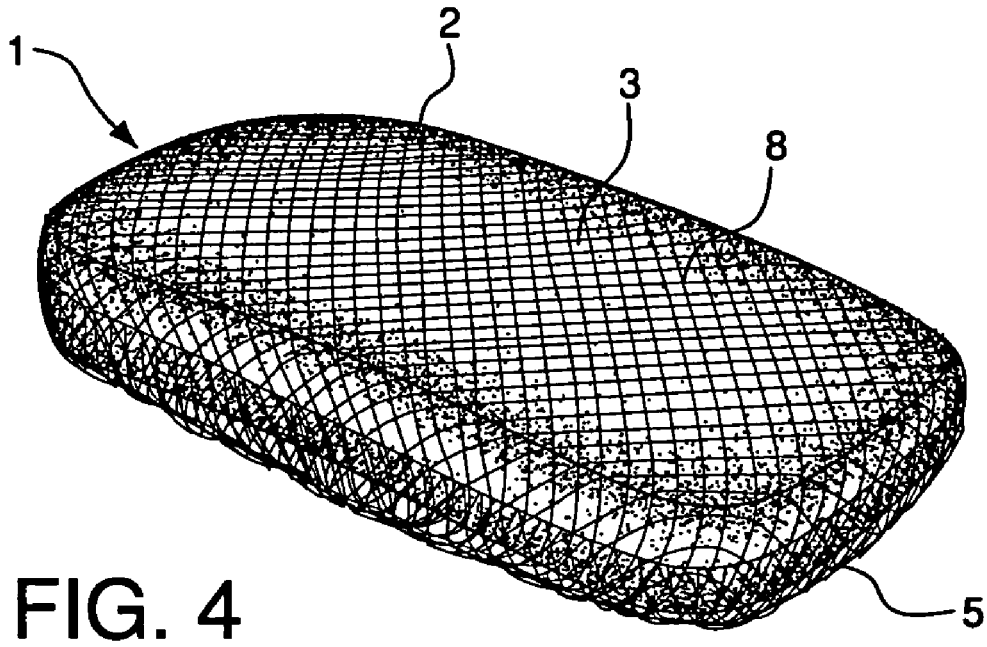
FIG. 4 is an isometric view of one cleaning surface used on the bonnet of the present invention.

Cleaning bonnet 1 of the present invention comprises a pad-like unitary body 2 with two face surfaces 3 and 4. Body 2 is made of a foam or sponge-like material. Cover 5 substantially encompasses pad 2. Cover 5 comprises two interconnected pieces 6 and 7 with cleaning surfaces 8 and 9 respectively. As shown more particularly in FIGS. 1 and 4, cover 5 can be of mesh-type configuration; and this configuration, in combination with face surfaces 3 and 4 of pad 2, results in bonnet 1 having two scrubbing surfaces.

Figure 5:
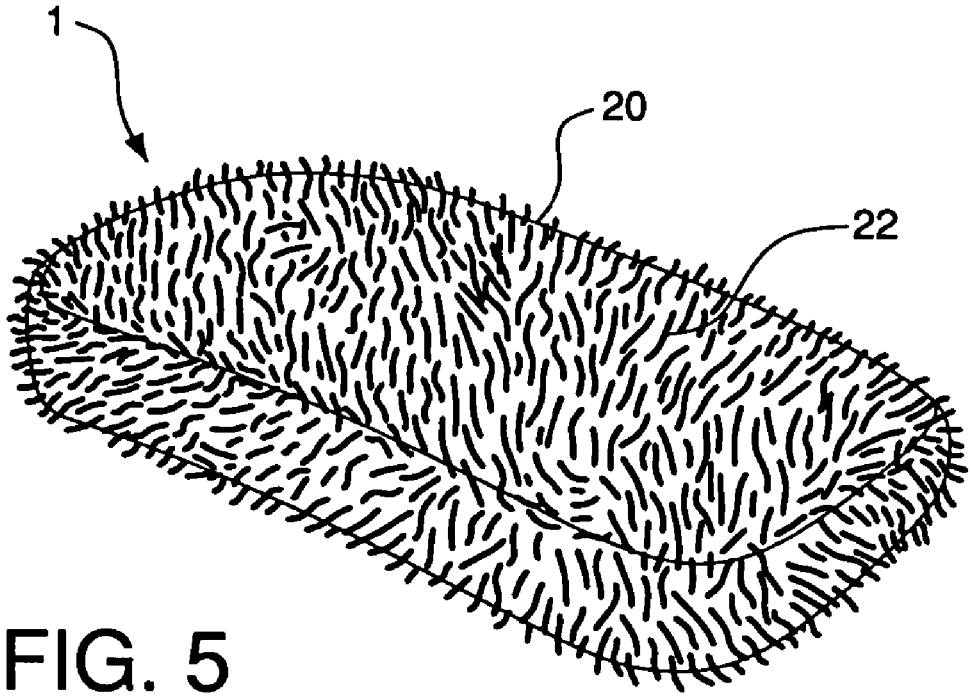
FIG. 5 is an isometric view of an alternate cleaning surface used on the bonnet of the present invention.

FIG. 5 shows another cover 20 contemplated by this invention. Cover 20 employs a different cleaning surface, i.e. strand-mop surface 22. The subject invention is not deemed to be restricted to the type of cleaning surface employed by the bonnet of the invention. Any known scrub, strand-mop, cloth, dusting, wiping or equivalent cleaning surface can be employed as the cleaning surface of the subject invention.

Figure 2:
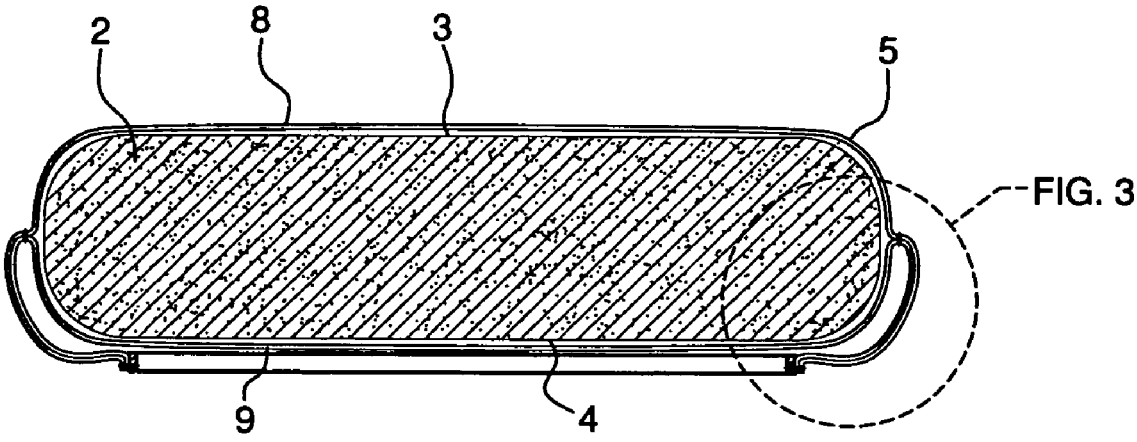
FIG. 2 is a cross-section of the bonnet of the present invention, taken from FIG. 1C.
Figure 3:
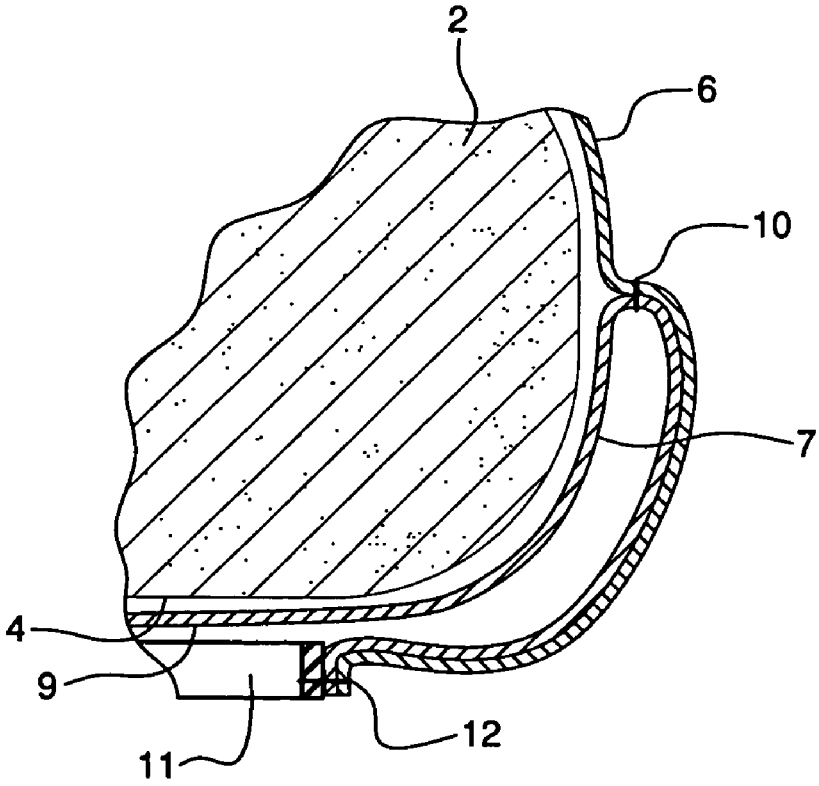
FIG. 3 is a detail of the cross-section of FIG. 2.

Cleaning surfaces 8 and 9 of cover pieces 6 and 7, as shown more specifically in FIGS. 2 and 3, extend toward the sides of the cover and pieces 6 and 7 are attached by sewed or other connection at 10. Elastic, expandable band 11 of cover 5 is sewed or otherwise attached to pieces 6 and 7 at 12. When band 11 is positioned directly over either cleaning surface 8 or cleaning surface 9, it contracts to form opening 13.

To use bonnet 1, opening 13 is expanded outwardly and the bonnet is positioned over and around support plate member 32 of cleaning implement 30. Upon releasing band 11, the band's elasticity causes it to contract, serving to secure and maintain bonnet 1 around cleaning support member 32 of cleaning implement 30. See FIG. 1A Reference is made to applicant's co-pending U.S. application, Ser. No. 11/069,149. now U.S. Pat. No. 7,120,962, entitled Cleaning Tool Head With Dual Cleaning Members, the disclosure of which is incorporated by reference herein, merely as an example of the cleaning implement to which the subject bonnet is to be used. However, the subject invention is not restricted to use on this type of cleaning implement.

Figure 1A:
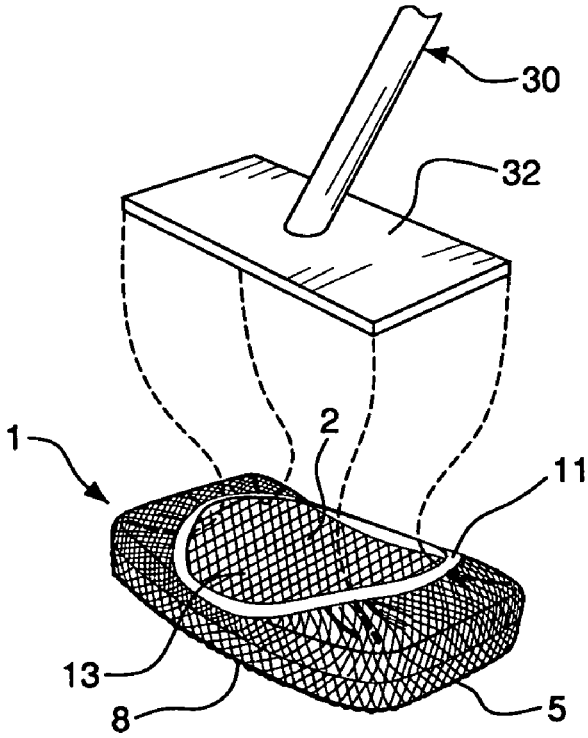
FIGS. 1A-1D show the sequence of adjusting the bonnet of the present invention, to be used in both its cleaning positions.
Figure 1B:
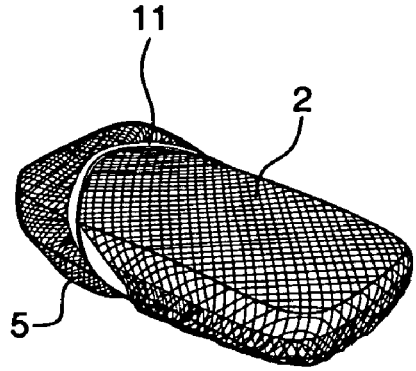
Figure 1C:
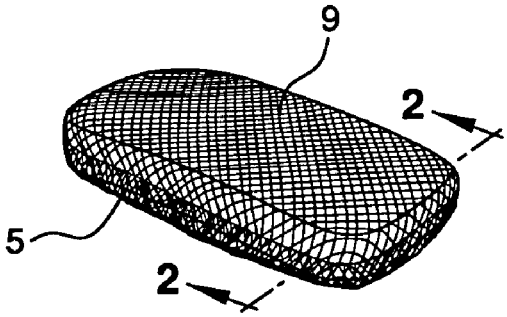
Figure 1D:
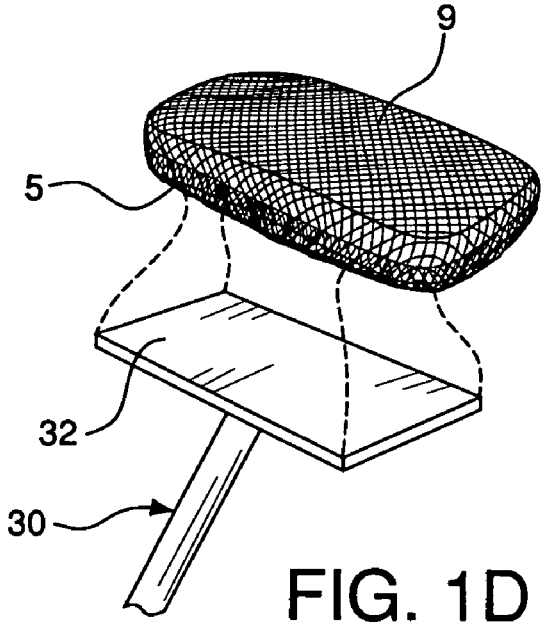

As is best seen in the sequential representation shown in FIG. 1, FIG. 1A depicts cleaning surface 8 of bonnet 1 to be used as the cleaning surface of cleaning implement 30. When it is desired or necessary to change the cleaning surface of bonnet 1, band 11 is expanded and plate member 32 withdrawn from opening 13. The position of cover 5 is then changed by pulling the ends of band 11 laterally and down around the sides of pad 2. See FIG. 1B. The elasticity provided by band 11 causes it again to contract, resulting in opening 13 being formed by the band, this time with the opening being located on the underside of pad 2. FIG. 1C. Plate member 32 of cleaning implement 30 then can be re-inserted within opening 13, thus permitting use of cleaning surface 9 of bonnet 1. FIG. 1D.

Thus, cleaning bonnet 1 provides two cleaning surfaces by simply positioning cover 5 to expose cleaning surface 8 and then folding cover 5 back around pad 2 to expose cleaning surface 9. In so doing, cleaning bonnet 1 is truly reversible and can be made available for use with two different cleaning surfaces or two of the same cleaning surfaces, providing versatility to cleaning implement 30, and similar cleaning tools with adaptable cleaning support member 32. Bonnet 1 is also easily removeable from cleaning support member 32 for cleaning the bonnet and permitting reattachment for reuse in either position.

Certain novel features and components of this invention are disclosed in detailed in order to make the invention are disclosed in detail in order to make the invention clear in at least one form thereof. However, it is to be clearly understood that the invention as disclosed is not necessarily limited to the exact form and details as disclosed, since it is apparent that various modification and changes may be made without departing from the spirit of the invention.

The invention claimed is:

1. A cleaning bonnet for use on the head of a cleaning implement, said bonnet comprising:

a unitary body with first and second faces;

a cover comprising first and second cover pieces which are secured together at a first location adjacent to the midsection of the unitary body, said cover pieces each comprising different surface means to clean soiled areas, said cover being adjustable to a first cleaning position whereby the surface means of the first cover piece overlays said first face for cleaning soiled areas, to a second cleaning position whereby the surface means of the second cover piece overlays said second face for cleaning soiled areas, each of said cover pieces further comprising extended sections which overlay the surface means and encompass substantially half of the unitary body, the extended sections being secured together at a second location adjacent to the surface means; and expandable means for permitting adjustment of the cover means between the first and second positions, said expandable means being connected to the extended sections of the cover pieces at the second location.

2. The cleaning bonnet as in claim 1 wherein the expandable means attaches the bonnet to the head of a cleaning implement.

3. The cleaning bonnet as in claim 1 wherein the expandable means comprises an elastic band.

4. The cleaning bonnet as in claim 1 wherein at least one of the surface means comprises a scrubber surface.

5. The cleaning bonnet as in claim 1 wherein at least one of the surface means comprises a strand mop surface.

* * * * *